United States Patent [19]

Bäckström

[11] Patent Number: 4,637,785

[45] Date of Patent: Jan. 20, 1987

[54] ROTARY PUMP WITH CUTTER DEVICE FOR CONTAMINATED FLUIDS

[76] Inventor: Hans Bäckström, Rymdvågsgatan 14, Västra Frölunda, Sweden, 421 33

[21] Appl. No.: 733,764

[22] PCT Filed: Sep. 13, 1984

[86] PCT No.: PCT/SE84/00298

§ 371 Date: May 14, 1985

§ 102(e) Date: May 14, 1985

[87] PCT Pub. No.: WO85/01327

PCT Pub. Date: Mar. 28, 1985

[30] Foreign Application Priority Data

Sep. 16, 1983 [SE] Sweden ..... 8304985

[51] Int. Cl.[4] ..... F04C 2/107; F04C 15/00; B02C 18/06

[52] U.S. Cl. ..... 418/48; 418/181; 241/185 A

[58] Field of Search ..... 418/46, 48, 181; 415/121 B; 241/185 A

[56] References Cited

U.S. PATENT DOCUMENTS

| | | | |
|---|---|---|---|
| Re. 29,626 | 5/1978 | Allen | 418/48 |
| 2,516,388 | 7/1950 | Humphreys | 417/519 |
| 3,224,376 | 12/1965 | Schade | 415/121 B |

FOREIGN PATENT DOCUMENTS

| | | | |
|---|---|---|---|
| 1963681 | 6/1971 | Fed. Rep. of Germany | 418/48 |

*Primary Examiner*—John J. Vrablik

*Attorney, Agent, or Firm*—Wegner & Bretschneider

[57] ABSTRACT

Apparatus for handling of fluids contaminated by solid objects and/or being partly solidified comprises a displacement pump of the screw type, as well as a cutter device driven by the pump shaft. The cutter device comprises a cylindrical drum with a number of axially directed edge steel, spaced apart a suitable distance to ensure a maceration of solid objects to a size suited for passing through the pump. The drum is located adjacent to an opening in the side wall of the pump housing. The pump is preferably reversible, and the material in the cutter device is selected so as to ensure a non-sparking structure.

2 Claims, 2 Drawing Figures

ROTARY PUMP WITH CUTTER DEVICE FOR CONTAMINATED FLUIDS

During the decontamination of oil or chemical spillage, the cleaning of tanks, the transportation of waste water and on many other occasions of fluid matter handling problems are encountered in that the fluid to be pumped contains floating, solid objects of varying size, lumps of asphalt-like consistency, or that the fluid itself has been partly solidified due to the action of chemicals, and so forth.

The lack of suitable equipment for the handling of such fluids has proven to be a definite bottleneck during many decontamination operations. It is desirable to have at hand a compact, high-capacity pumping unit, which is not affected by contaminants or agglomerations in the fluid, i.e. the pump should itself have a capacity to fragmentate the floating member to a size suitable for passing through the pump.

A means according to the invention therefore includes a displacement pump enclosed in a housing and driven by a motor, and is characterized in a cutter device connected to the drive shaft of the motor, and arranged, when rotating concentrically therewith, to cooperate with at least one cutting edge located at the inlet to the pump housing.

The cutter device preferably includes a cylindrical drum structure, having a number of axially directed edge steels, the relationship between the rotational speed of the pump during cavitation-free flow and the peripheral distance between the edge steels at least corresponding to the size of the biggest, solid contaminant having a possibility to pass through the pump.

The pump is advantageously a screw pump, enclosed by a stator and connected to the pump shaft by way of an eccentrically movable link having two universal joints.

The pump ought to be of a reversible type, the edge steels having double-sided edges, and the opening having oppositely directed counter-edges.

The edge steels and the holders therefore are formed so as to provide a certain pumping activity within the cutter device.

Figure 1:
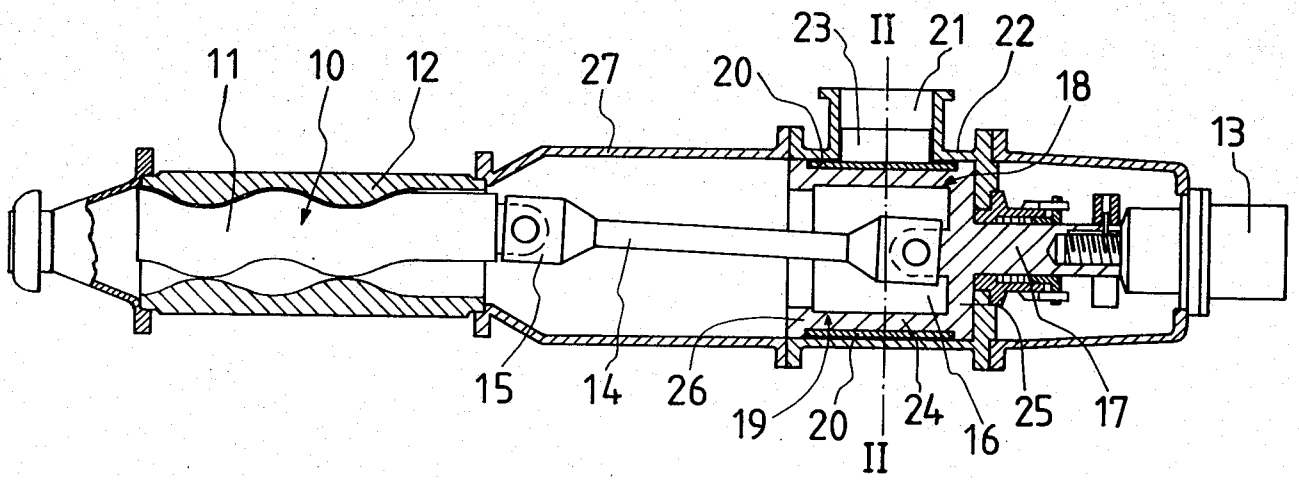
Figure 2:
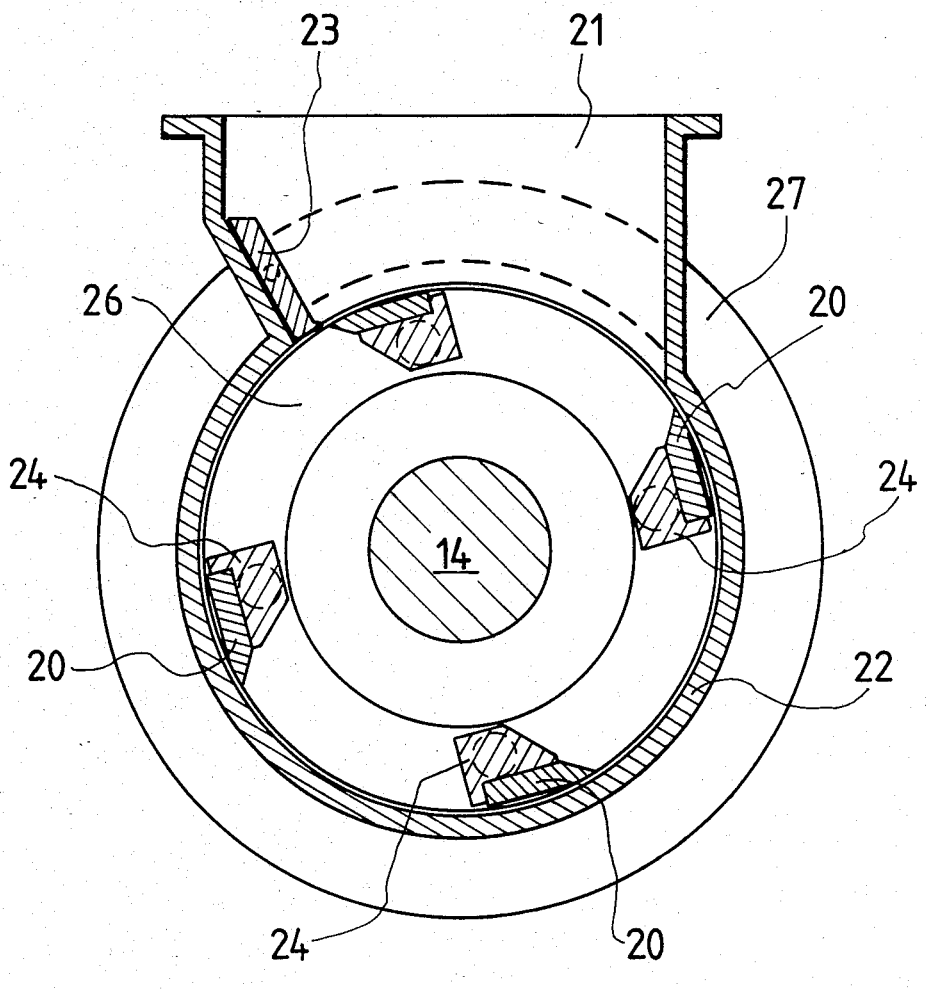

The invention will below be described with reference to the accompanying drawings, in which FIG. 1 shows a longitudinal section through a pumping means according to the invention, and FIG. 2 shows a section along line II—II in FIG. 1.

The pumping means shown in the drawings comprises a displacement pump 10 of the screw type, for instance a so called "MONO"-pump, having a rotor 11 enclosed by a stator 12 of elastically deformable material. A pump of this type can handle fluids containing contaminants of a certain size.

The pump is driven by a motor 13, axially aligned with the pump rotor. Due to the oscillating movements of the pump rotor, the torque transfer path contains an eccentrically movable link 14 with two universal joints 15 and 16. A shaft portion 17, connected to the motor drives a cutter device 18, formed as a cylindrical drum 19 in which four axially directed edge steels 20 are mounted in holders 24, extending between a disc-shaped part 25 of the shaft, and a juxtaposed ring 26. The holder will, in use, rotate concentrically with respect to the motor axis.

The relationship between the rotational speed of the pump, during cavitation-free operation and the spacing between the holders 24 will at least correspond to the size of the biggest solid particles able to pass through the pump 10. No solid contaminant will thus, after the passage through the cutter device, cause any trouble in the pump. The inlet 21 to the pump is arranged in the wall of a cylindrical extension 22 of the pump housing 27.

Foreign objects in the fluid, which are bigger than what the pump can handle, will temporarily be caught in the inlet 21 to the pump, and will be macerated by the edge steels 20 in cooperation with counter-edge steels 23 along one side edge of the opening. Solidified fluids, or agglomerations therein will be ground or mashed by the cutter device, as the fluid passes into the housing 22.

One or more counter-steels may be fitted in the opening, and in a simple arrangement a border portion defining the opening may be sharpened to an edge.

The pumping means should be able to withstand chemical attacks, and due to the nature of many of the fluids, which are actual for handling, the material selected for the edge steels 20 and the counter steels should be of a non-sparking quality. The pump should be submersible and self-feeding, and should provide a satisfactory working pressure, even when handling low-viscous fluids.

The pump and the motor are preferably reversible, so it will be possible, on occasions, to wash away matter clogging the suction line. The edge steels can then be provided with double-sided edges, and a double set of counter steels should be provided. The motor can be selected so the number of revolutions can be varied, but as the cutter device will operate at the same speed, the maceration will automatically be adjusted to changes in the pumping capacity. Alternatively it is possible to provide a step-up gearing, so the cutter device will rotate faster than the pump. The edge steels 20 and their holders are preferably designed so a certain pumping action is obtained, i.e. the cutter device will act as a pumping step, preceding the displacement pump.

I claim:

1. A rotary pump for contaminated fluids comprising:

an elongate housing having first and second ends;

an orbiting rotary displacement pump at said first end;

a driving motor having a drive shaft at said second end;

at least one radially directed inlet to said housing, adjacent to said second end;

a hollow drum having an end wall and a cylindrical side wall provided with axial openings and located within said housing inside said radial inlet;

edge steels defining said openings in the side wall of said drum and at least one counter cutting edge at said at least one radial inlet; and means for connecting said drum end wall concentrically with the drive shaft of said motor, as well as a universal connection means passing from said end wall, through said drum to said displacement pump for driving the same.

2. A rotary pump according to claim 1, in which said rotary drum with its edge steels is formed so as to provide a booster pumping activity.

* * * * *